US006247456B1

(12) United States Patent
Everingham et al.

(10) Patent No.: US 6,247,456 B1
(45) Date of Patent: Jun. 19, 2001

(54) CANISTER PURGE SYSTEM HAVING IMPROVED PURGE VALVE CONTROL

(75) Inventors: Gary Everingham; John E. Cook; Paul D. Perry; Murray F. Busato, all of Chatham (CA)

(73) Assignee: Siemens Canada Ltd, Mississauga (CA)

( * ) Notice: Subject to any disclaimer, the term of this patent is extended or adjusted under 35 U.S.C. 154(b) by 0 days.

(21) Appl. No.: 09/039,795

(22) Filed: Mar. 16, 1998

Related U.S. Application Data

(62) Division of application No. 08/739,741, filed on Nov. 7, 1996, now Pat. No. 5,727,532.

(51) Int. Cl.[7] ..... F02M 37/04

(52) U.S. Cl. ..... 123/520; 123/458

(58) Field of Search ..... 123/520, 521, 123/519, 518, 516, 458

(56) References Cited

U.S. PATENT DOCUMENTS

| | | | |
|---|---|---|---|
| 3,703,165 | 11/1972 | Hansen | 123/136 |
| 4,753,212 | 6/1988 | Miyakir | 123/458 |
| 4,791,905 | 12/1988 | Furata | 123/497 |
| 4,793,313 | 12/1988 | Paganon | 123/506 |
| 4,877,005 | 10/1989 | Law | 123/458 |
| 4,944,276 | 7/1990 | House | 123/520 |
| 4,966,195 | 10/1990 | McCabe | 251/129.08 |
| 5,040,559 | 8/1991 | Ewing | 251/129.08 |
| 5,054,454 | 10/1991 | Hamburg | 123/520 |
| 5,092,302 | 3/1992 | Mohan | 123/497 |
| 5,174,262 | 12/1992 | Staerzl | 123/458 |
| 5,191,870 | 3/1993 | Cook | 123/520 |
| 5,193,508 * | 3/1993 | Motoyama | 123/458 |
| 5,237,980 | 8/1993 | Gillier | 123/520 |
| 5,265,842 | 11/1993 | Sorah et al. | 251/129.08 |
| 5,277,167 | 1/1994 | Deland | 123/518 |
| 5,311,903 | 5/1994 | Poulin | 251/129.1 |
| 5,383,438 | 1/1995 | Blumenstock | 123/520 |
| 5,413,082 | 5/1995 | Cook et al. | 123/458 |
| 5,425,349 * | 6/1995 | Nagaishi | 123/674 |
| 5,429,099 | 7/1995 | Deland | 123/520 |
| 5,727,532 | 3/1998 | Everingham et al. | 123/520 |

FOREIGN PATENT DOCUMENTS

| | | | |
|---|---|---|---|
| 0015167 | 1/1982 | (JP) | 251/129.08 |

* cited by examiner

*Primary Examiner*—Carl S. Miller

(57) ABSTRACT

The purge valve embodies a solenoid that has a linear force vs. current characteristic acting on the armature. Effects of hysteresis are minimized by certain constructional features and the manner of operating the valve by an associated control circuit.

10 Claims, 10 Drawing Sheets

CANISTER PURGE SYSTEM HAVING IMPROVED PURGE VALVE CONTROL

This a divisional of application Ser. No. 08/739,741 filed on Nov. 7, 1996 now U.S. Pat. No. 5,727,532.

FIELD OF THE INVENTION

This invention relates to on-board evaporative emission control systems for internal combustion engine powered motor vehicles. Such systems comprise a vapor collection canister that collects fuel vapor emitted from a tank containing volatile liquid fuel for the engine and a purge valve for periodically purging collected vapor to an intake manifold of the engine.

BACKGROUND AND SUMMARY OF THE INVENTION

Contemporary systems typically comprise a solenoid-operated purge valve that is under the control of a purge control signal generated by a microprocessor-based engine management system. A typical purge control signal is a duty-cycle modulated pulse waveform having a relatively low frequency, for example in the 5 Hz to 50 Hz range. The modulation ranges from 0% to 100%. The response of certain conventional solenoid-operated purge valves is sufficiently fast that the valve follows to some degree the pulsing waveform that is being applied to it, and this causes the purge flow to experience similar pulsations. Such pulsations may at times be detrimental to tailpipe emission control objectives since such pulsing vapor flow to the intake manifold may create objectionable hydrocarbon spikes in the engine exhaust. Changes in intake manifold vacuum that occur during normal operation of a vehicle may also act directly on the valve in a way that upsets the control strategy unless provisions are made to take their influence into account, such as by including a vacuum regulator valve. Moreover, low frequency pulsation may produce audible noise that may be deemed disturbing.

A general aspect of the present invention is to provide a canister purge valve that is capable of providing more accurate control in spite of influences that tend to impair control accuracy. In furtherance of this general objective, a more specific aspect is to provide a canister purge valve with a linear solenoid actuator. Other more specific aspects relate to various constructional features, such as details of the valve and seat elements.

The foregoing, along with additional features, and other advantages and benefits of the invention, will be seen in the ensuing description and claims which are accompanied by drawings. The drawings disclose a preferred embodiment of the invention according to the best mode contemplated at this time for carrying out the invention.

DESCRIPTION OF THE PREFERRED EMBODIMENT

Figure 1:
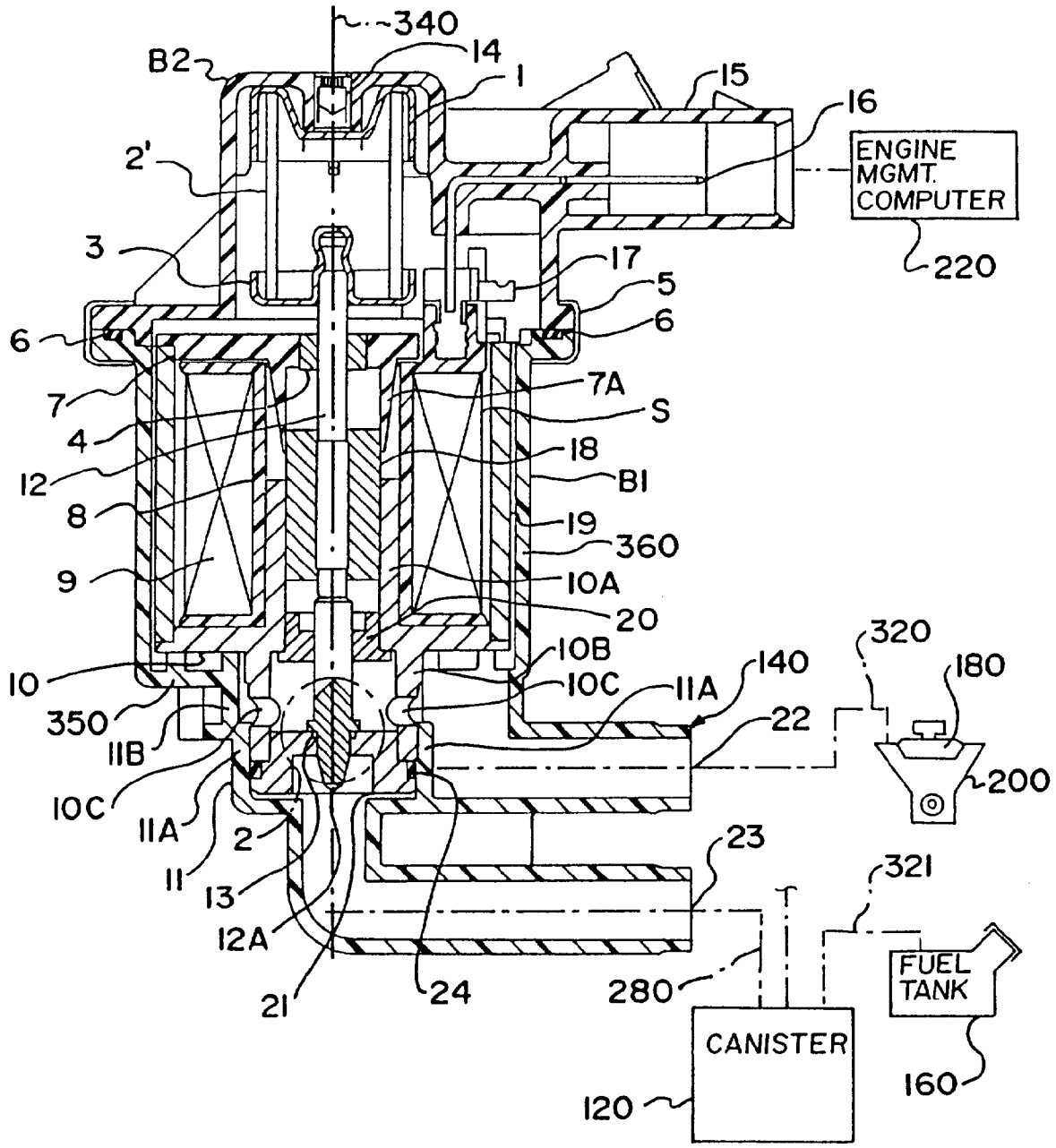
FIG. 1 is a longitudinal cross-sectional view through a first embodiment of canister purge solenoid valve embodying principles of the invention and showing the valve in association with an evaporative emission control system.

FIG. 1 shows an evaporative emission control system 100 of a motor vehicle comprising a vapor collection canister 120 and a canister purge solenoid valve 140 connected in series between a fuel tank 160 and an intake manifold 180 of an internal combustion engine 200 in the customary fashion. An engine management computer 220 supplies a purge control signal for operating valve 140.

Valve 140 comprises a two-piece body B1, B2 having an inlet port 23 that is coupled via a conduit 280 with the purge port of canister 120 and an outlet port 22 that is coupled via a conduit 320 with intake manifold 180. A conduit 321 communicates the canister tank port to the head space of fuel tank 160. Canister purge solenoid valve 140 has a longitudinal axis 340, and body piece B1 comprises a cylindrical side wall 360 that is coaxial with axis 340 and that is open at the upper axial end where it is in assembly with body piece B2. At its lower axial end body piece B1 comprises a side wall 11 that is coaxial with axis 340, and radially intercepted by port 22. A shoulder 350 joins side wall 11 with side wall 360. Side wall 11 contains a shoulder the joins respective lower and upper portions 11A, 11B of the side wall 11; the former portion is fully cylindrical while the latter portion is partly cylindrical. Port 23 is in the shape of an elbow that extends from the lower axial end of side wall 11. By itself, body piece B1 is enclosed except for its open upper axial end and the two ports 22 and 23.

A solenoid S is disposed in body piece B1, fitting through the open upper end of piece B1 during assembly. The solenoid comprises a bobbin 8, magnet wire 9 wound on bobbin 8 to form a bobbin-mounted electromagnetic coil, and stator structure associated with the bobbin-coil. This stator structure comprises an upper stator end piece 7 disposed at the upper end of the bobbin-coil, a cylindrical side stator piece 19 disposed circumferentially around the outside of the bobbin-coil, and a lower stator end piece 10 disposed at the lower end of the bobbin-coil.

Upper stator end piece 7 includes a flat circular disk portion whose outer perimeter fits to the upper end of side piece 19 and that contains a hole into which a bushing 4 is pressed so as to be coaxial with axis 340. The disk portion also contains another hole to allow for upward passage of a pair of bobbin-mounted electrical terminals 17 to which ends of magnet wire 9 are joined. Piece 7 further comprises a cylindrical neck 7A that extends downwardly from the disk portion a certain distance into a central through-hole in bobbin 8 that is co-axial with axis 340. The inner surface of neck 7A is cylindrical while its outer surface is frustoconical so as to provide a radial thickness that has a progressively diminishing taper as the neck extends into the bobbin through-hole.

Lower stator end piece 10 includes a flat circular disk portion whose outer perimeter fits to the lower end of side piece 19 and that contains a hole into which a bushing 20 is pressed so as to be coaxial with axis 340. Piece 10 further comprises an upper cylindrical neck 10A that extends upwardly from the disk portion a certain distance into the central through-hole in bobbin 8 and that is co-axial with axis 340. Neck 10A has a uniform thickness. Piece 10 still further comprises a lower cylindrical neck 10B that extends downwardly from the disk portion a certain distance so that its lowermost end fits closely within the lower portion 11A of side wall 11. A valve seat element 21 is necked to press-fit into the lower end of neck 10B and is sealed to the inside of wall portion 11A by an O-ring 24. Above the lowermost end that fits to side wall 11, neck 10B contains several through-holes 10C that provide for communication between port 22 and the space disposed above seat element 21 and bounded by neck 10B. The upper portion 11B of side wall 11 is shaped as described earlier in order to provide this communication by not restricting through-holes 10C.

Bushings 4 and 20 serve to guide a valve shaft 12 for linear motion along axis 340. A central region of shaft 12 is slightly enlarged for press-fit of a tubular armature 18 thereto. The lower end of shaft 12 is fashioned with a valve element that coacts with a valve seat element 21. The valve element of FIG. 1 is in the general form of a tapered pintle and comprises a frustoconical tip 12A having a rounded end.

Just above tip 12A an O-ring type seal 13 is disposed around the shaft for sealing against seat element 21. Details of the seat element will be described later in connection with FIG. 2. FIG. 1 shows the seal seated closed on element 21 to close the flow path between ports 22 and 23. In this position the upper portion of armature 18 axially overlaps the air gap that exists between the upper end of neck 10A and the lower end of neck 7A, but slight radial clearance exists so that armature 18 does not actually touch the necks, thereby avoiding magnetic shorting.

The upper end of shaft 12 protrudes a distance above bushing 4 and is shaped to provide for attachment of a spring seat 3 thereto. With piece B2 attached to piece B1 by a clinch ring 5 which grips confronting, mated flanges to sandwich a seal 6 between them, a helical coiled spring 2' is captured between seat 3 and another spring seat 1 that is received in a suitably shaped pocket of piece B2. A calibration screw 14 is threaded into a hole in this pocket coaxial with axis 340 and is externally accessible by a suitable turning tool (not shown) for setting the extent to which spring seat 1 is positioned axially relative to the pocket. Increasingly threading screw 14 into the hole increasingly moves seat 1 toward spring seat 3, increasingly compressing spring 2' in the process. Terminals 17 are also joined with terminals 16 mounted in piece B2 to form an electrical connector 15 for mating engagement with another connector (not shown) that connects to engine management computer 220.

When solenoid S is progressively energized by current, armature 18 is pulled upwardly against the opposing spring force of spring 2' to unseat the valve from the seat and open the valve so that flow can occur between ports 22 and 23. Generally speaking, the degree of valve opening depends on the magnitude of current flow through the coil so that by controlling the current flow, the purge flow through the valve is controlled. Detail of this control and the valve response will be explained at greater length later on in connection with further description of the novel aspects of this invention.

Figure 2:
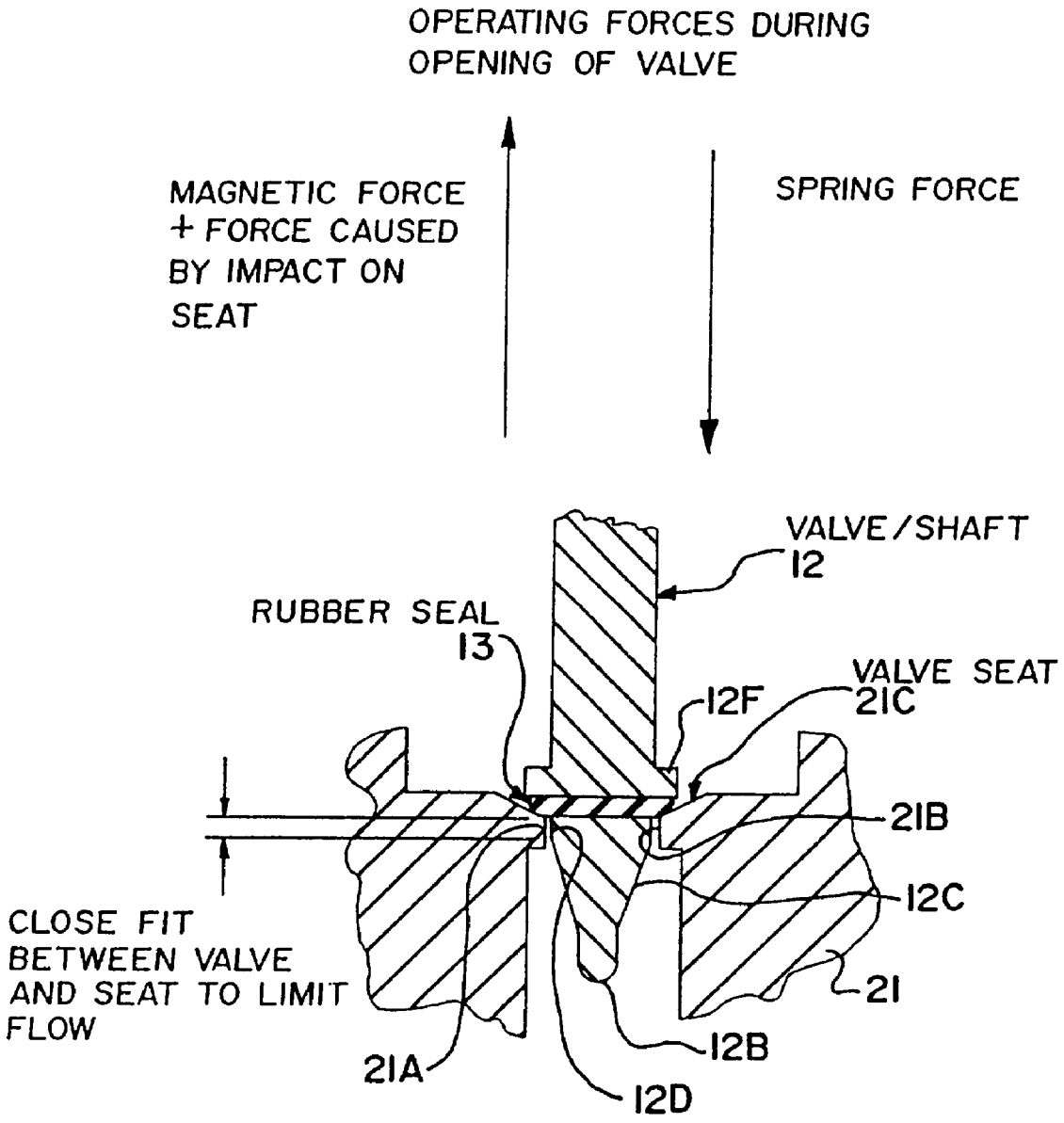
FIG. 2 is an enlarged fragmentary view in circle 2 of FIG. 1 depicting a modified form.

FIG. 2 shows detail of a modified form of valve element at the lower end of shaft 12 and detail of the seat element 21. The valve element comprises a rounded tip 12B, a frustoconical tapered section 12C extending from tip 12B, a straight cylindrical section 12D extending from section 12C, a rubber O-ring type seal 13 disposed on the shaft immediately above section 12C, and an integral back-up flange 12F for the upper end of the seal. The through-hole in seat element 21 comprises an inwardly directed shoulder 21A having a straight cylindrical section 21B and a frustoconical seat surface 21C extending from section 21B and open to the interior space bounded by neck 10B. In the closed position shown, a rounded surface portion of seal 13 has circumferentially continuous sealing contact with seat surface 21C proximate section 21B, and section 12D is axially co-extensive with section 21B.

As the valve shaft is initially displaced upwardly to begin unseating the valve element from the seat element, O-ring seal 13 will lose contact with seat surface 21C, but the straight section 12D will still continue to axially overlap with section 21B for a certain amount of upward travel. Thus, the effective open area for flow will be substantially constant until such overlap ceases at which time the tapered section 12C will be coextensive with section 21B. Continued upward motion of shaft 12 will now cause the effective area to progressively increase until the tip 12B passes through. After the tip has passed out of section 21B, the through-hole will cease to be restricted by the valve element.

Figure 3:
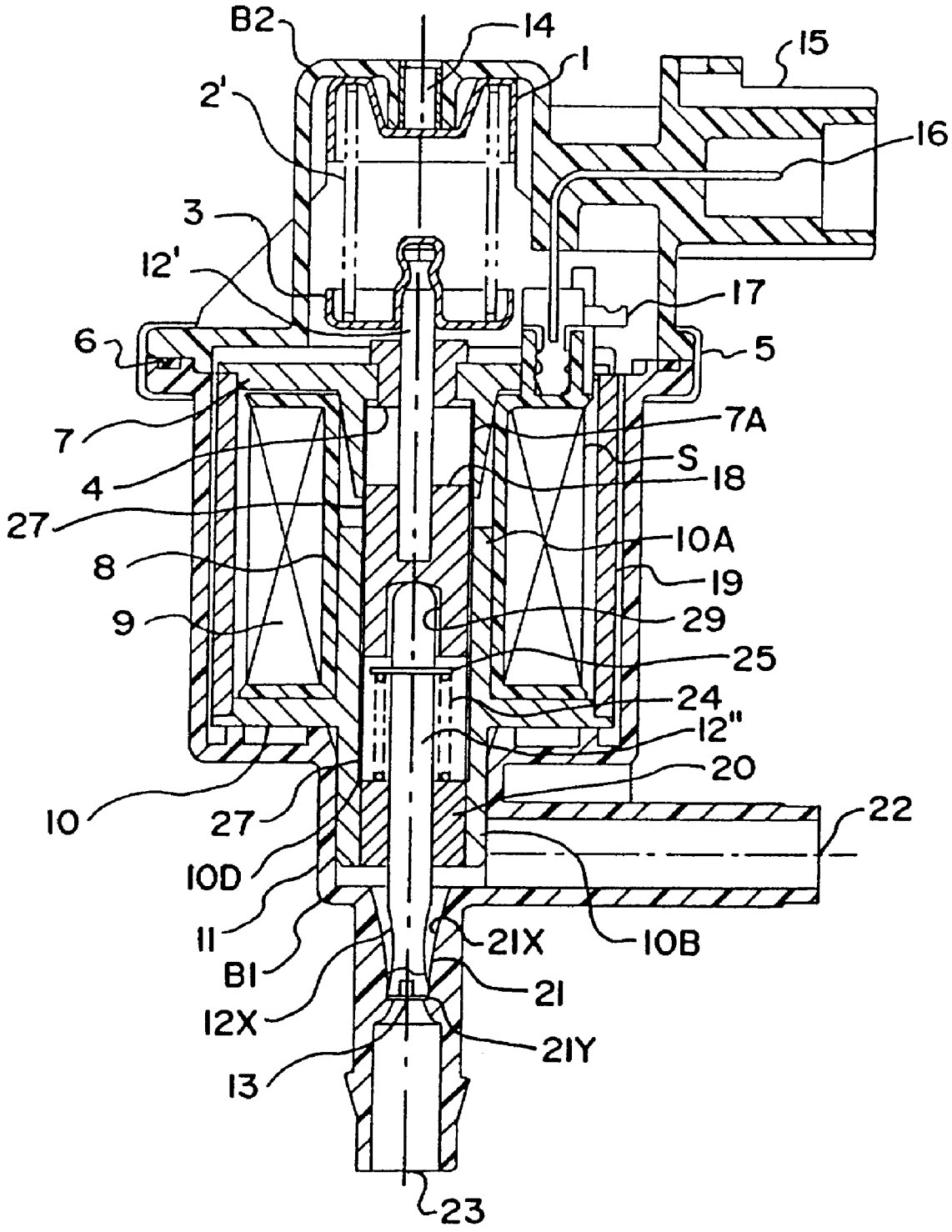
FIG. 3 is a longitudinal cross-sectional view through a second embodiment of canister purge solenoid valve embodying principles of the invention.

FIG. 3 shows another embodiment of canister purge solenoid valve in which parts corresponding to like parts in FIGS. 1 and 2 are identified by the same reference numbers, even though there may be some differences. Only the significant differences between FIG. 3 and FIGS. 1 and 2 will be explained, it being understood that otherwise the respective parts, their relationship to the valve, and their function are essentially the same. In FIG. 3, port 23 is straight, rather than an elbow, and seat element 21 is integrally formed in body piece B1 rather than being a separate insert. Shaft 12 comprises a two-piece construction comprising an upper shaft portion 12' and a lower shaft portion 12". Upper shaft portion 12' is guided by bushing 4, passing upwardly therethrough to attach to spring seat 3, as in FIG. 1, but armature 18 has a blind hole for pressing onto the lower end of shaft portion 12'. The upper end of a cylindrical sleeve 27 is fitted to the inside of neck 7A, and the sleeve's lower end is fitted to the inside of neck 10A, extending not only the full length of that neck, but also partially into neck 10B as far as a shoulder 10D. Sleeve 27 provides guidance for linear motion of armature 18 so that the assembly consisting of the armature and upper shaft portion 12' is guided at two axially spaced apart locations.

Sleeve 27 is a high magnetic reluctance material so as to avoid otherwise detrimental magnetic shorting of the armature to the stator end pieces. Brass is a suitable material for the sleeve since it also has fairly low frictional resistance to sliding. Bushings 4 and 20 are preferably of a material that avoids magnetic shorting and provides low frictional resistance to sliding. Graphite-impregnated bronze is a suitable material. Shaft 12 is preferably a non-magnetic stainless steel so that armature 18 is essentially the only flux conductor disposed in the magnetic circuit air gap between necks 7A and 10A.

Lower shaft portion 12" is guided by bushing 20 and comprises a flange 25 spaced a certain distance below a rounded upper tip end. A helical coil spring 24 is disposed around shaft portion 12" between the upper end of bushing 20 and flange 25 for resiliently biasing lower shaft portion 12" in the upward direction away from the bushing. The lower end of armature 18 contains a blind hole 29 having a diameter slightly larger than the upper tip end of shaft portion 12" and a base that is slightly concave. The rounded upper tip end of shaft portion 12" bears against this concave base of hole 29 due to the force of spring 24. The force exerted by spring 24 is much less than that exerted by spring 2', so that spring 24 merely causes lower shaft portion 12" to track upward displacement of armature 18. Downward displacement of armature 18, when the valve is open, acts directly on shaft portion 12" to force it downwardly in unison with the armature, increasingly compressing spring 24 in the process. An important advantage of the two-piece construction of the shaft shown in FIG. 3 is that alignment of the bushings and the valve seat is less critical than in the one-piece shaft construction of FIG. 1. Thus, it may be possible to reduce manufacturing tolerances on individual parts, even though more parts are required in the FIG. 3 embodiment. It can be appreciated that a two-part shaft, like that of FIG. 3 can be designed into the valve of FIG. 1, in appropriate situations.

The lines of magnetic flux that pass through the armature between neck 7A and neck 10A when the solenoid is energized have both axial and radial components, although the axial component is dominant. The radial components as a practical matter will never be perfectly balanced, and hence will exert a net radial force on the armature urging the armature sideways. The two-piece shaft construction is advantageous in a valve where the net radial component of magnetic force that acts on the armature is significant. The effect of such radial magnetic force on the valve of FIG. 3 will act only on the armature and upper shaft portion, and since their linear motion has only two point guidance, the influence of such radial force is more readily tolerated than in the case of three-point guidance, as in FIG. 1. Thus, three-point guidance typically requires more precise alignment and closer part and assembly tolerances. In the FIG. 3 valve, radial force acting on the armature is not transmitted in any significant way to the lower shaft portion 12" due to the nature of the contact between the concave base of hole 29 and the rounded tip end of shaft portion 12", and also to the radial clearance provided between the hole and the shaft portion. Control of the alignment of the valve seat element to bushing 20 and control of the alignment of bushing 4 to sleeve 27 can be accomplished independently, and this eliminates the greater precision typically required for a three-point alignment.

Seat element 21 and the lower end of lower shaft portion 12" are shaped to provide flow which is substantially insensitive to changes in intake manifold vacuum when the valve is opened a certain minimum amount and the engine manifold vacuum is greater than a certain minimum, i.e. sonic flow. Seat element 21 comprises a side surface 21X that is nozzle-contoured as shown and a shoulder 21Y at the lower end of the side surface 21X. Shoulder 21Y circumscribes the opening through the port 23 to the interior of the valve passage leading to port 22. The side wall surface 12X of the lower end of lower shaft portion 12" that confronts side surface 21X is concavely contoured as shown. The lower tip end of shaft portion 12 contains a rubber seal 13 whose perimeter has full circumferential sealing contact with the seat that is provided by the upper surface of shoulder 21Y, when the valve is closed, as shown.

Side wall 11 is slightly different in FIG. 3 in that it is straight throughout except for being open where it faces port 22. Neck 10B stops short of the lower end of side wall 11 to provide a space just above the upper end of side surface 21X for flow to pass to port 22 after the flow has passed through the opening circumscribed by shoulder 21Y when the valve is open.

When solenoid S is progressively energized by current, armature 18 is pulled upwardly against the opposing spring force of spring 2'. Spring 24 forces the lower shaft portion 12" to follow, thereby unseating seal 13 from the seat provided by shoulder 21Y and opening the valve so that flow can occur between ports 22 and 23. Once again speaking generally, the degree of valve opening depends on the magnitude of current flow through the coil so that by controlling the current flow, the purge flow through the valve is controlled. Detail of this control and the valve response will be explained at greater length later on in connection with further description of the novel aspects of this invention.

Figure 4:
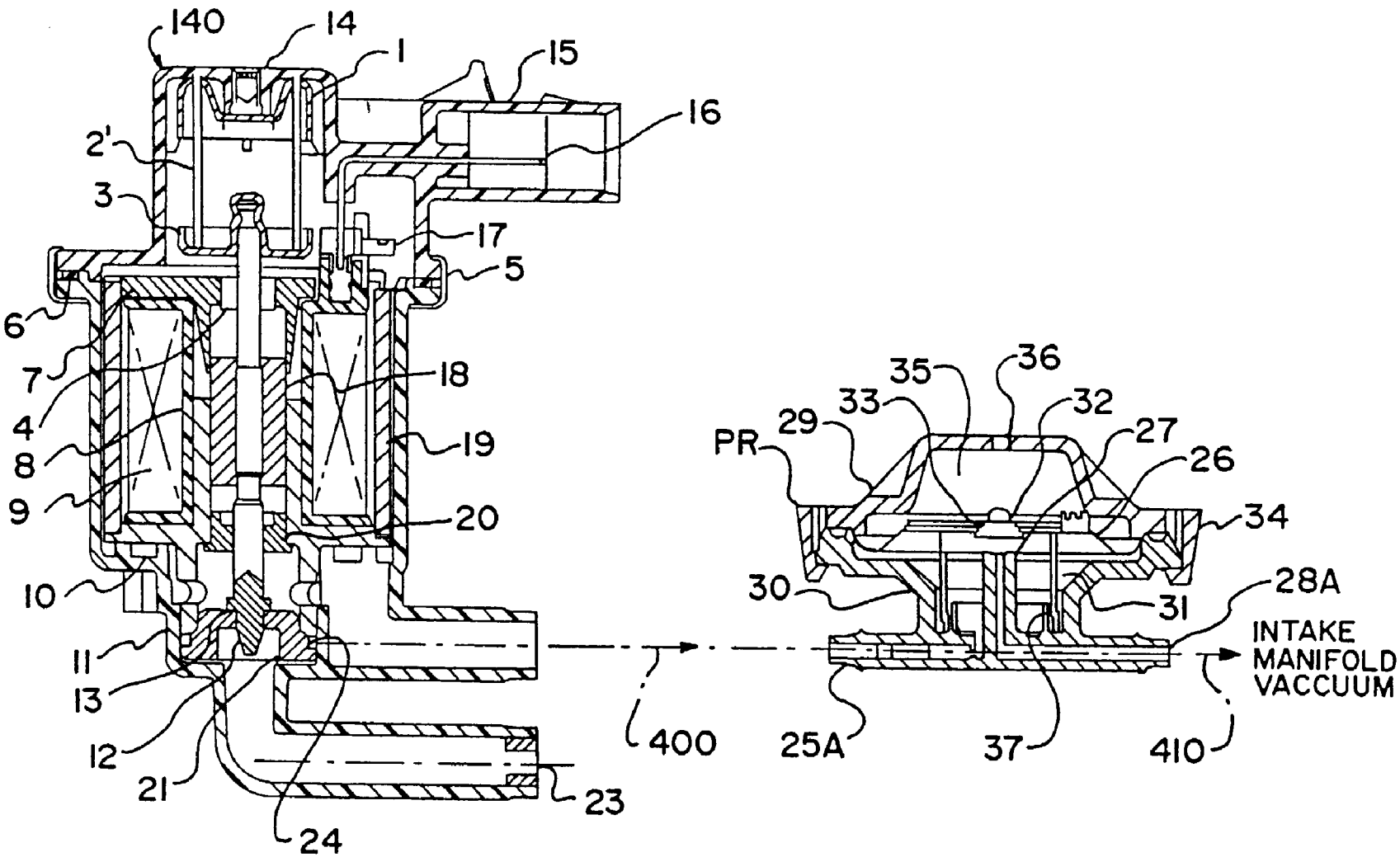
FIG. 4 shows the valve of FIG. 1 in association with a pressure regulator.

FIG. 4 shows valve 140 of FIG. 1 associated with a pneumatic regulator PR. The pneumatic regulator functions to provide, for a given amount of valve opening, a substantially constant flow that is independent of intake manifold vacuum, provided that such vacuum exceeds a certain minimum. This is desirable for many control strategies. When valve 140 is open, outlet port 22 is communicated to intake manifold vacuum through the pneumatic regulator, the latter having an inlet port 25A connected to port 22 via a conduit 400 and an outlet port 28A connected to manifold 180 via a conduit 410.

Regulator PR comprises a body 30 containing an internal diaphragm 26 that defines an expandable volume 31 between the body and the diaphragm. A valve 32 is attached to a rigid insert 33 that is an integral part of the diaphragm and disposed at a central region of the diaphragm. The perimeter margin of the diaphragm is held compressed against a rim of body 30 by a cap 29 having integral snap fasteners 34 for attaching the cap to the body. A second expansable volume 35 is defined by the diaphragm and the inside of the cap and is communicated to atmosphere through a vent orifice 36. A spring 37 is disposed in the body for biasing the diaphragm and valve in a direction away from a seat 27 that is at the end of a passage extending from port 28A and that is disposed for coaction with the valve. As intake manifold vacuum progressively increases, vacuum within expandable volume 31 will exert a force on diaphragm 26 that opposes the force of spring 27 and causes the diaphragm to move axially toward the seat. When the vacuum reaches a sufficient level, valve 32 seals against seat 27 blocking communication between ports 23 and 28A. The vacuum in volume 31 will then decay back through the canister purge valve 140 and the force on the diaphragm will diminish to a level that is insufficient to maintain the seal between valve 32 and seat 27. When the force of the spring 37 unseats the valve, vacuum in volume 31 will again begin to increase until sufficient to again seat the valve. This is a regulating cycle that repeats as necessary to maintain an average vacuum level in volume 31. This average level is a function of the spring force and the effective area of the diaphragm. Since this average vacuum is substantially constant, flow through valve 140 will be similarly substantially constant for a given degree of opening of valve 140, despite variations in intake manifold vacuum above the necessary minimum vacuum level. Although FIG. 4 shows regulator PR as a separate assembly, it can be integrated into the canister purge valve if desired. It is to be noted that valve action in the regulator occurs between port 28A and expansable volume 31 so that true regulation of vacuum magnitude occurs.

Figure 5:
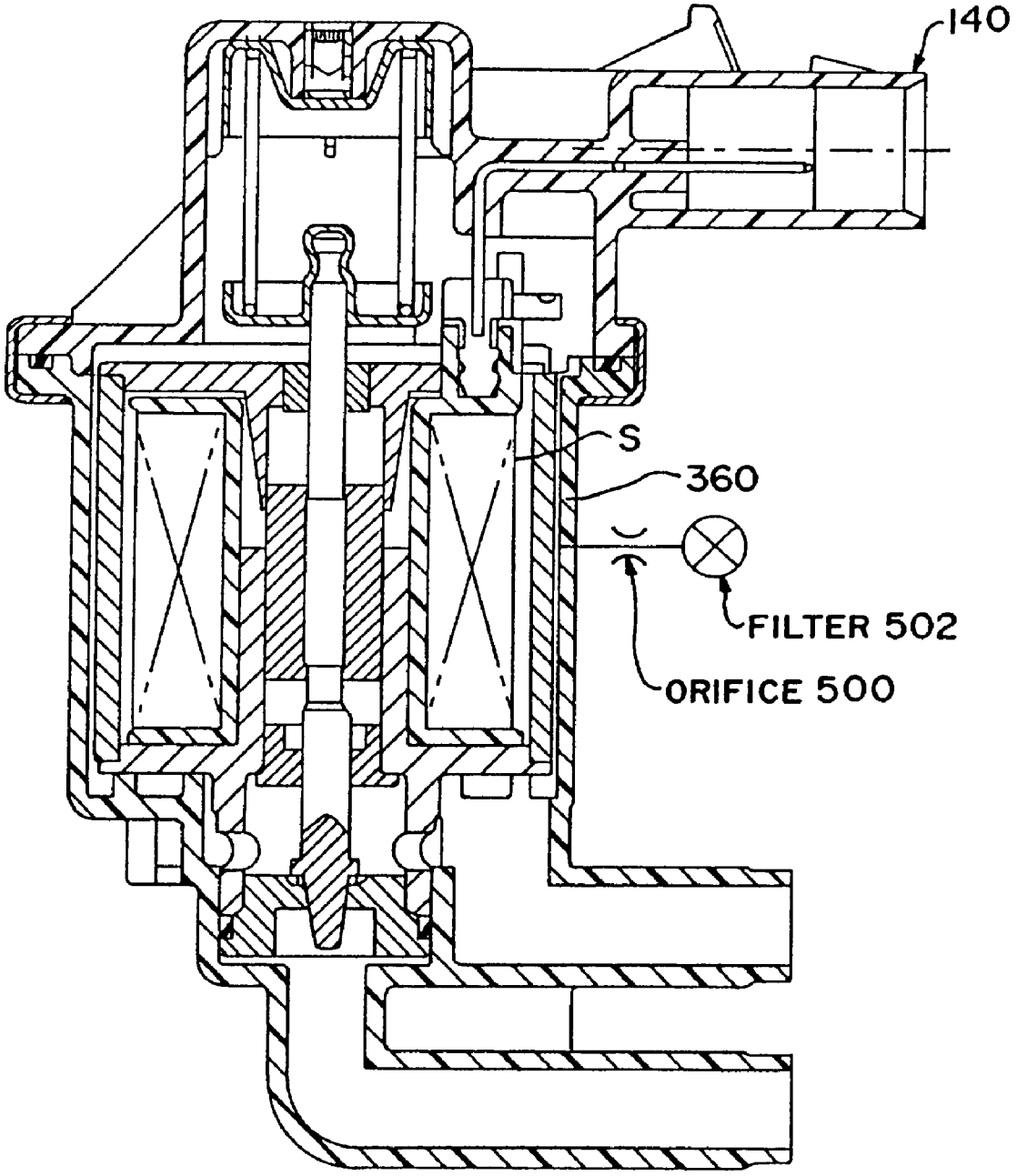
FIG. 5 shows the valve of FIG. 1 with an additional feature schematically portrayed.

FIG. 5 incorporates an added feature into the valve of FIG. 1. This feature is the inclusion of an atmospheric bleed through the wall 360 of the body in the vicinity of the solenoid S. This specific embodiment of the feature comprises an orifice 500 and a filter 502 arranged to communicate the space inside the wall to atmosphere. The use of the filter is to prevent certain contaminants from intruding into the valve.

Such a bleed prevents any significant accumulation of vacuum that may intrude from the purge flow path upwardly into the space containing the solenoid, and hence prevents the potential adverse influence of such vacuum on the solenoid's operation.

Figure 6:
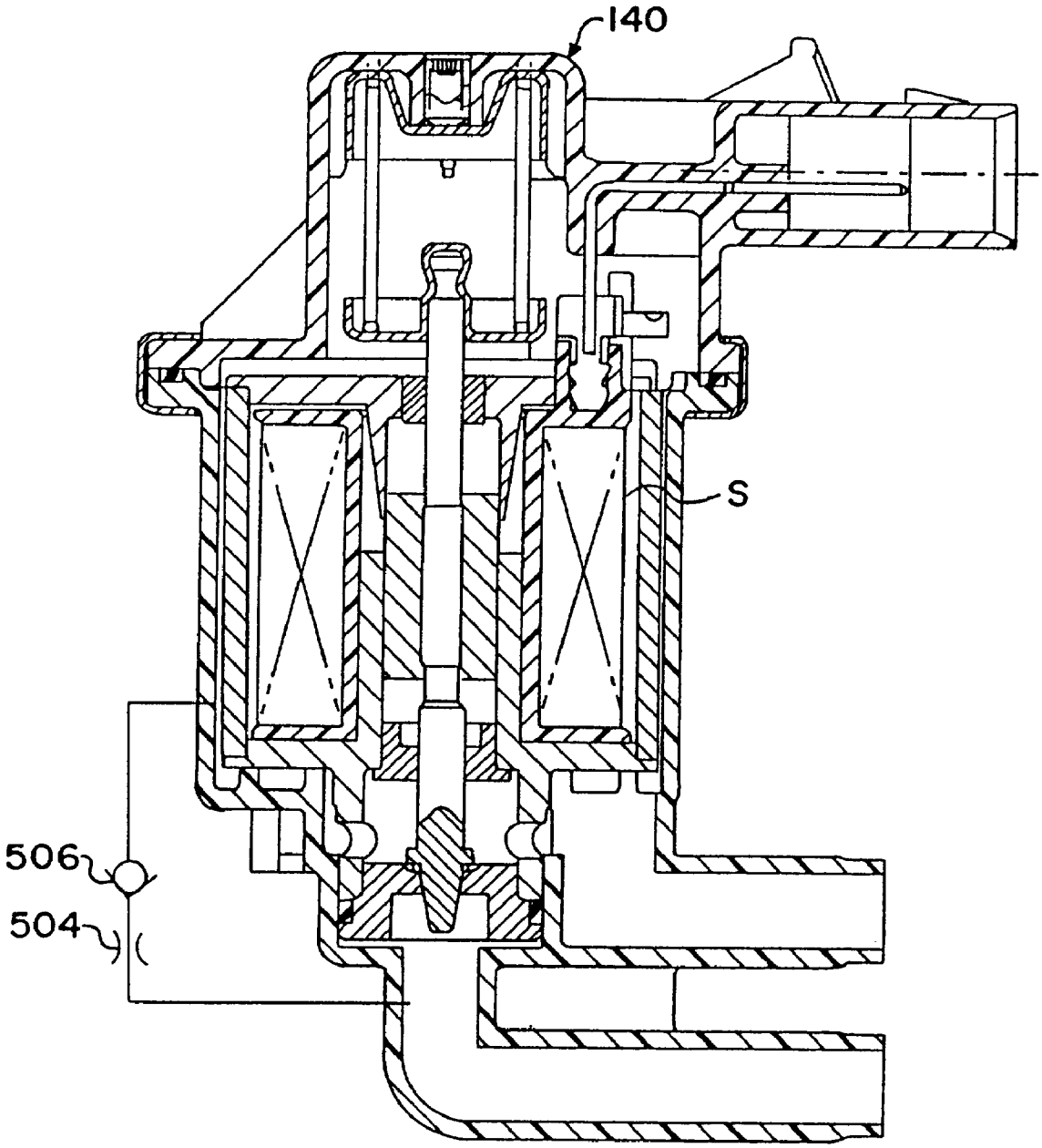
FIG. 6 shows the valve of FIG. 1 with an additional feature schematically portrayed.

FIG. 6 shows another means to accomplish the same objective of preventing vacuum from affecting the solenoid operation. This means comprises routing the solenoid space to the canister port through an orifice 504 and a one-way check valve 506, as shown. The check valve is used to seal the bleed orifice during legislated leak testing of the evaporative emission system, and it must have an operating differential sufficient to assure that it will not leak during such testing. The fact that inlet port 23, rather than outlet port 22, is the one connected to the canister is advantageous for such testing because any flow path to atmosphere in that portion of the purge valve construction that is disposed beyond seals 13 and 24 relative to port 23 will not create a false test result in a system that otherwise complies with regulatory requirements, whereas a test on a system using port 22 as the canister port could show non-compliance due to such a flow path to atmosphere.

The organization and arrangement of solenoid S in the forgoing embodiments endows the solenoid with a substantially linear operating characteristic over its operating range. The solenoid's linear operating characteristic is obtained by the relative shaping of the stator structure in the vicinity of the armature. This shaping is such that if the solenoid were to act on the armature alone in the absence of spring 2', the axial magnetic force exerted on the armature would be a substantially linear function of the electric current flowing in the solenoid coil 9. Once the effect of spring 2' is taken into account, (the spring has a substantially linear compression vs. force characteristic in the illustrated embodiments), it can be appreciated that for a given current flow, the armature will assume a position along axis 340, where the magnetic force and the spring force cancel each other. Increasing the current will cause the armature to be increasingly displaced upwardly, increasingly compressing the spring until the forces are in balance, while decreasing the current will allow the spring to relax until balance is again achieved. The actual flow characteristic of any given purge valve is a function of not only the linear operating characteristic of the solenoid but also of the flow characteristic embodied in the design of the valve element and the valve seat element, and of the force vs. compression characteristic of spring 2'. Thus, the flow vs. current characteristic of any given purge valve can be made to be either linear or non-linear, depending on particular usage requirements. For example, a spring with a non-linear characteristic could be used instead of a linear one.

A preferred electrical input that is applied across the terminals 16 of the canister purge valve is a pulse width modulated (PWM) waveform composed of rectangular voltage pulses having substantially constant voltage amplitude and occurring at a certain frequency. The width of the pulses determines the extent to which the valve opens, and so by varying the pulse widths, the valve operates to various degrees of opening. As the pulse width increases, so does the average current flowing through the solenoid coil. Since the strength of the magnetic field created in the coil and acting on armature 18 is equal to the product of the number of turns in the coil and the average current, the force that is applied to the armature will increase as the pulse width increases.

The minimum pulse width (in terms of time duration) that is required to open a closed purge valve (the start-to-open, or STO value) is set by the extent to which spring 2' is compressed by the positioning of spring seat 1 by calibration screw 14. However, upon termination of such a pulse, spring 2' will begin to force the valve element toward closed position. If a succeeding pulse is not applied within a certain amount of time, the valve element will re-establish contact with the seat surface. For example, when such a first pulse is applied to a purge valve, such as those of FIGS. 1–3, seal 13 will actually lose contact with the seat surface to allow some flow through the purge valve, but it will be forced back against the seat surface by the action of spring 2' if the next pulse is not applied in sufficient time. The total mass impacting the seat has a certain inertia, and in relation to the force of spring 2', the inertial impact force will cause the moving mass to rebound to some degree. Where the valve element includes an elastomeric seal 13, as in the disclosed embodiments of FIGS. 1–3, its compression characteristics will also have some effect on the rebound due to seat impact. This phenomenon is depicted generally in FIG. 2 by the opposing vectors respectively representing the spring force and the combined magnetic and impact forces.

Figure 7:
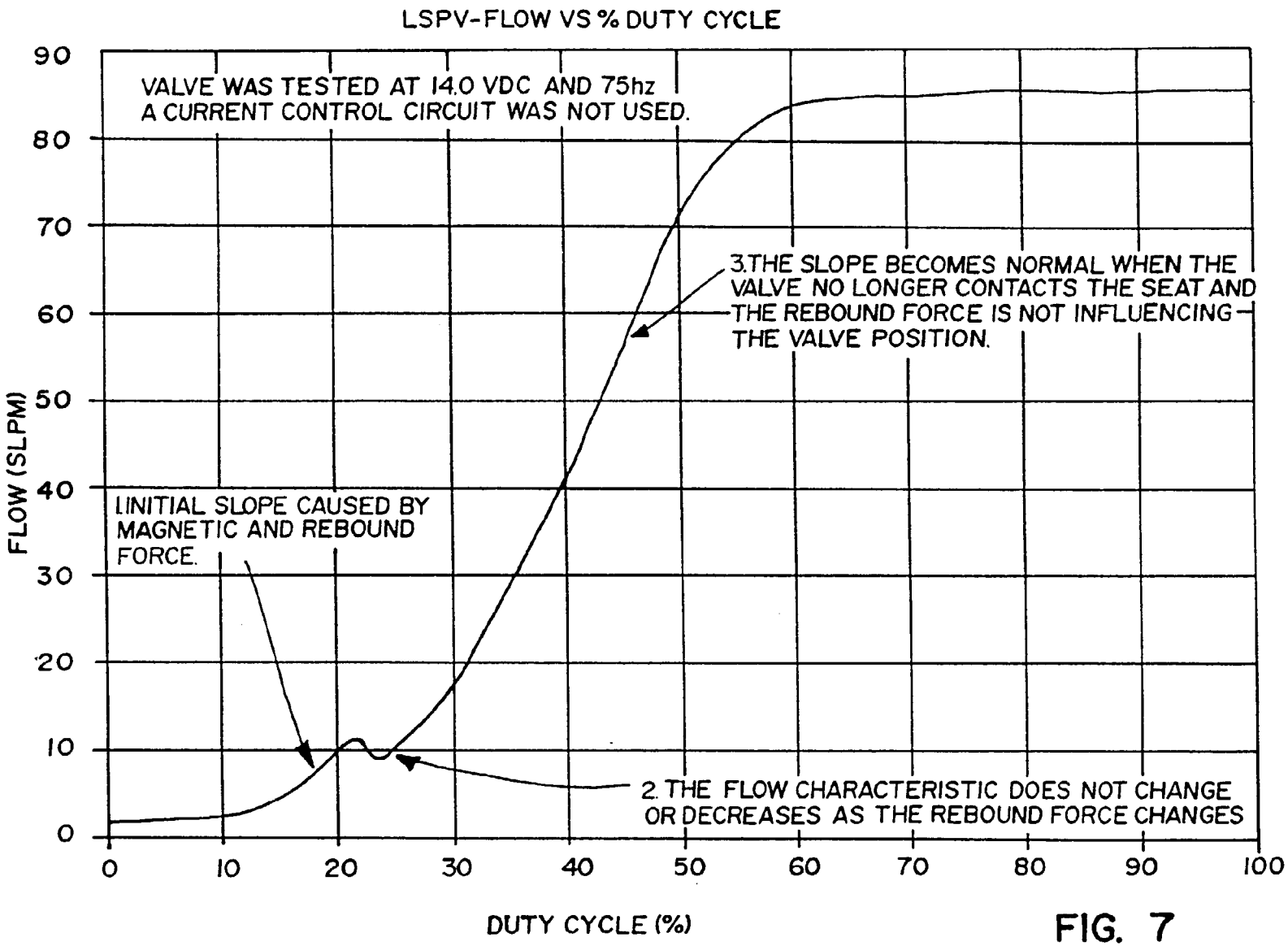
FIGS. 7, 8, and 9 are respective graph plots useful in explaining certain aspects of the invention.

FIG. 7 shows the flow vs. duty cycle characteristic for a purge valve to which a PWM voltage of 14.0 VDC amplitude and 75 Hz frequency was applied. Impacting of the valve element with the seat element occurs over the range of approximately 10% (at which the valve begins to open)to approximately 24% duty cycle. (The approximately one SLPM flow below the 10% duty cycle represents leakage in the test apparatus, and not leakage through the closed purge valve.) At the upper end of this range, namely from about 22% to about 24% duty cycle, there is a transition where flow may actually slightly decrease as the duty cycle increases. Above 24% duty cycle, there is no further impacting, and the characteristic is substantially linear up to about 50% duty cycle at which the flow is approximately 72 SLPM From about 50%–60% duty cycle, there is reduced linearity, and above about 60% duty cycle, the flow is substantially constant, representing maximum flow.

Such a characteristic may be satisfactory for certain usages, but for others, it may be deemed preferable to have better linearity in the lower duty cycle range. Such improvement may be obtained in several different ways.

Figure 8:
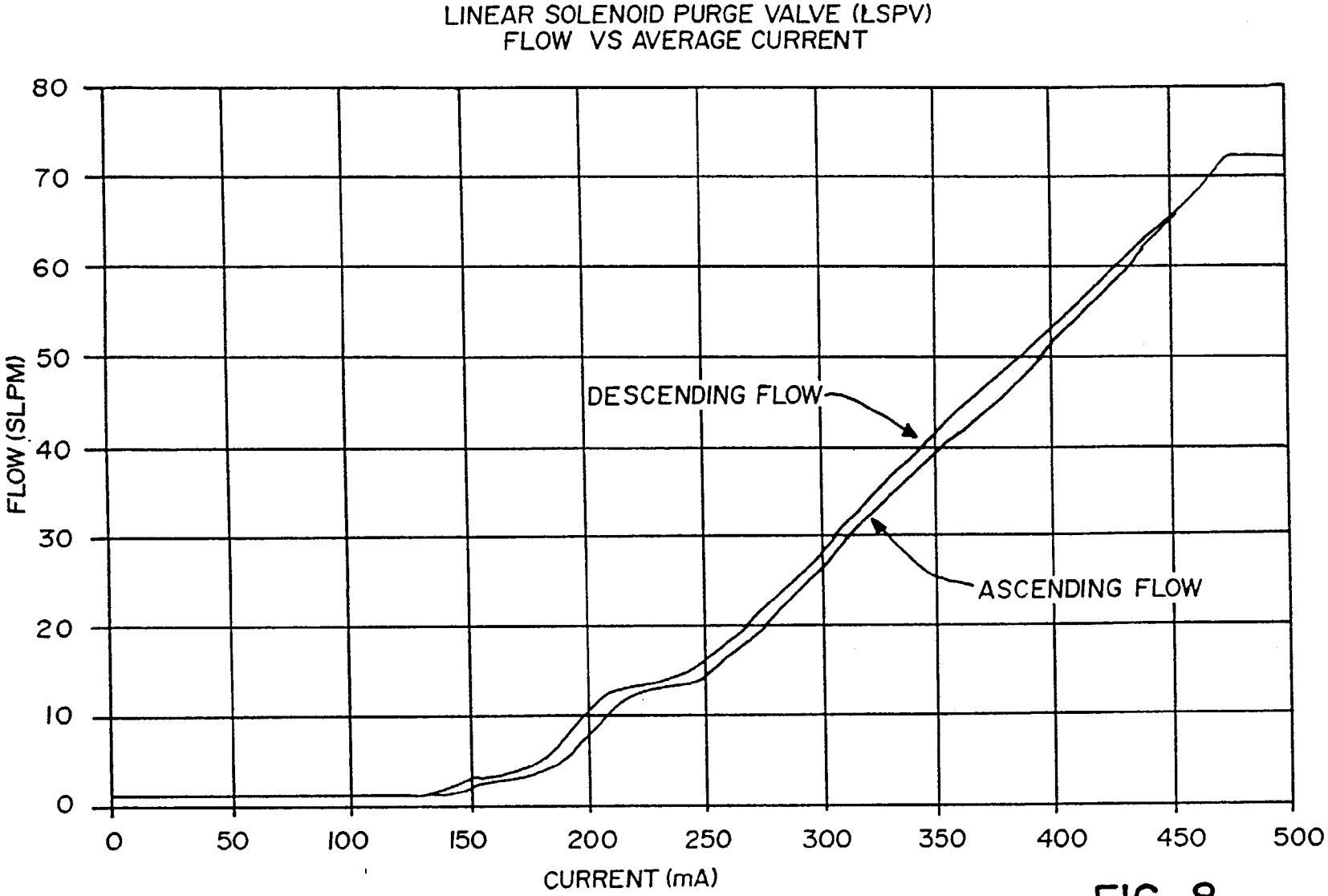

FIG. 8 depicts such an improved characteristic where flow is plotted as a function of average current, although the current is the result of applying a PWM voltage to the solenoid. One way of obtaining such improvement is by utilizing the valve element construction shown in FIG. 2 where the straight cylindrical section 12D will overlap the cylindrical surface 21B of the seat element during a certain initial range of positioning of the valve element in relation to the seat surface. This will cause the open area to be substantially unchanged over this initial range of opening movement of the valve element, and such an attribute will assist in making the characteristic curve more linear in this region. It may also be advantageous to increase the pulse frequency, for example to 150 Hz.

FIG. 8 further shows that the characteristic plot has slight hysteresis. While this may be unobjectionable for certain uses, certain procedures for applying the PWM signal, which will be explained in greater detail later, can eliminate its effects. Thus, not only are the purge valves themselves constructed to minimize such hysteresis, but the manner in which they are operated can further minimize hysteresis.

Figure 9:
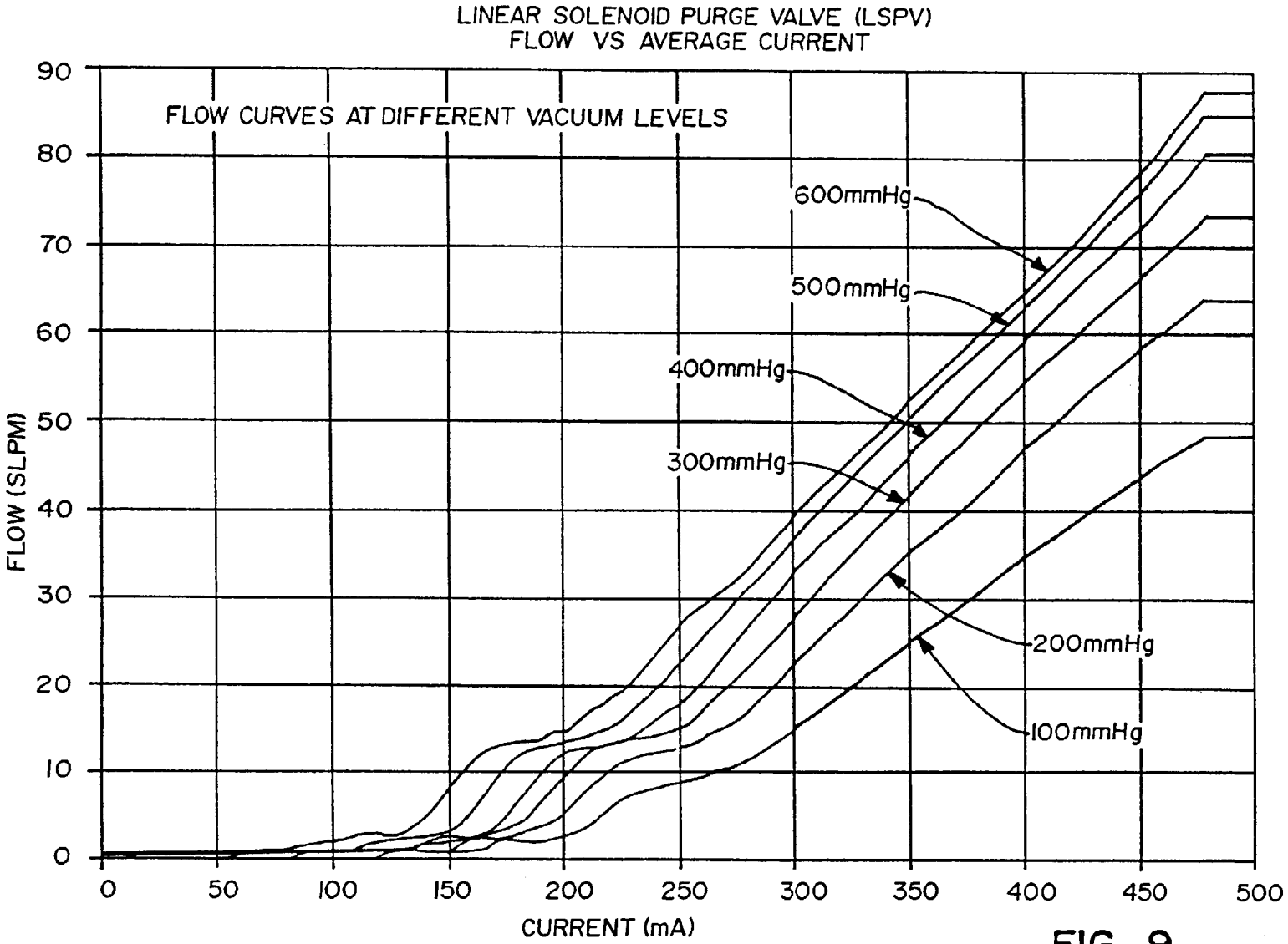

FIG. 9 discloses a series of characteristic plots for each of which flow is plotted as a function of average current. (The small hysteresis effect is not shown in each characteristic plot for clarity in illustration). Each characteristic plot is presented as a function of a particular magnitude of intake manifold vacuum. It can be seen that the characteristic plot at 300 mm. vacuum is fairly similar to the characteristic plot depicted by FIG. 8 for 254 mm. vacuum.

Such FIG. 9 plots characterize a purge valve like the tapered pintle valve in FIG. 1 when a pneumatic regulator is not used.

Use of a pneumatic regulator, as in FIG. 4, will substantially eliminate the effect of different manifold vacuum magnitudes on the purge valve, and such regulated purge will have essentially a single characteristic plot.

In response to a PWM input to the solenoid, the current flow in the coil may be considered to comprise a composite current that consists of an average DC component upon which is superimposed a fluctuating component that is related in frequency to the pulse frequency. The total mass of the armature and shaft is selected in relation to the magnetic force characteristic of the solenoid such that the mass will follow such a composite current. In other words, the mass will be positioned to a position correlated to the average DC component and will dither slightly at this position. Such dithering is beneficial in improving responsiveness to change in the current input that commands a change in the valve position by minimizing the influence of static friction that would occur in the absence of dither and by reducing the effect of hysteresis. When the valve element is only slightly opened, its impact with the seat surface before a succeeding pulse may be a result of dither, which by itself could be undesirable, but for the significant advantage that is obtained when the valve element is operated above this lower range; and as explained earlier, such effect may be ameliorated by the valve element design of FIG. 2 that provides a constant open area between the valve element and seat opening for initial displacement within this lower range. The amount of dither can be quite small, and in fact excessive dither is to be avoided since it can give rise to undesired pulsations in the purge flow.

Figure 10:
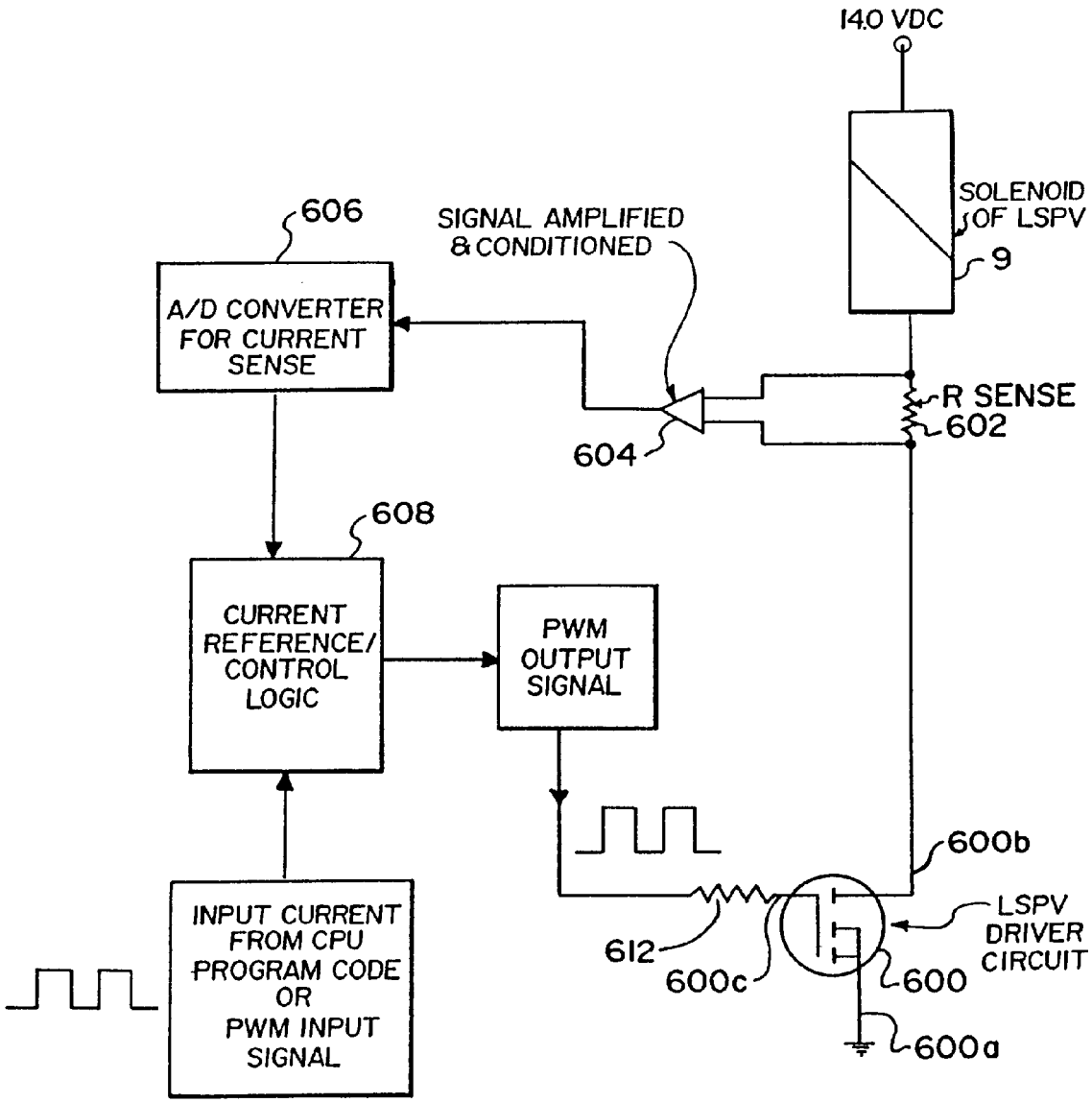
FIG. 10 is an electrical schematic block diagram of a control for operating a canister purge solenoid valve.

The effect of hysteresis can also be reduced by the circuit that is used to deliver and control the current flow in the solenoid coil. FIG. 10 shows an exemplary circuit. The circuit comprises a three-terminal solid state driver 600, a current sensing resistor 602, a signal conditioning amplifier 604, an A/D (analog-to-digital) converter 606, and a current reference/control logic 608. Solid state driver 600 has a controlled conductivity path between its principal conduction terminals 600*a*, 600*b*. Terminal 600*a* is connected to ground, and terminal 600*b* is connected to one terminal of resistor 602. The other terminal of resistor 602 is connected to one terminal of solenoid coil 9, and the other terminal of solenoid coil 9 is connected to a positive DC potential that is preferably well regulated. Solid state driver 600 further has a control input terminal 600*c* that controls the conductivity through its principal conduction path between terminals 600*a*, 600*b*. Terminal 600*c* is connected through a resistor 612 so that a PWM output signal from current reference/control logic 608 is applied to the control input of driver 600. The input of signal conditioning amplifier 604 is connected across resistor 602 and its output is connected to the input of A/D converter 606. The output of A/D converter 606 is connected to one input of current reference/control logic 608 while the other input of the latter receives an input signal from a source that provides a signal commanding a desired PWM signal to the solenoid coil. Much of this circuitry, with the exception of resistor 602, and possibly driver 600, may be embodied in a micro-controller-based engine management computer either in hardware, software, or a combination of both.

Resistor 602, conditioning amplifier 604, A/D converter 606, and current reference/control logic 608 provide coil current feedback information that is used to compensate for temperature change that changes the resistance of the copper wire forming coil 9. In this way the effect of temperature-induced changes in the resistance of the coil that would alter the desired current flow in the coil is essentially eliminated. If the DC supply voltage that is applied to the one terminal of the coil is not well regulated, it can be monitored, and any variations can be compensated in a similar way. Such compensations assure that the current flow in the coil is that which is commanded by the engine management computer. The compensations take the form of adjusting the pulse width of the actual pulses applied to operate driver 600, and such compensation is sometimes referred to as a switching constant current control.

Hysteresis can be eliminated by using a control strategy that causes the desired position to always be approached from the same direction. FIG. 8 shows both a descending flow characteristic and an ascending flow characteristic. By utilizing such a control strategy, a commanded position will always be reached along only one of these two characteristics. For example, if the ascending flow characteristic is to be used, and the valve is commanded to move in the direction of increasing opening, the command input simply is the desired target position. On the other hand if the valve is commanded to move in the direction of decreasing opening, the command input must first cause a slight overshoot in the direction of decreasing opening (since the valve will be actually following the descending flow characteristic), and thereafter, the command must command increasing opening to the target position (during which time the valve will follow the ascending flow characteristic).

While a presently preferred embodiment of the invention has been illustrated and described, it should be appreciated that principles are applicable to other embodiments that fall within the scope of the following claims. For example, while FIGS. 1 and 3 show a set screw calibration, it is possible to eliminate such calibration by selection of the correct individual spring prior to assembly, but such an alternative may be more costly for mass-production purposes. Likewise, different circuit components may be used in constructing a control circuit that performs in an equivalent way.

Also, an orifice can be disposed in the purge flow path. FIG. 4 shows an annular member comprising a fixed orifice disposed at the entrance of canister port 23. This orifice member provides a proportionate reduction in the purge flow characteristic, which includes defining the flow characteristic of the purge valve by itself when the tapered pintle valve element is sufficiently open to no longer restrict flow through the seat element. It is also possible for a variable orifice to be disposed in the purge flow path. Such a variable orifice is preferably disposed between the purge valve element and the manifold.

What is claimed is:

1. An electrically-operated canister purge valve for controlling purging of fuel vapors from a vapor collection canister to an internal combustion engine in accordance with a purge control signal that sets the extent to which the canister purge valve allows purge flow, the canister purge valve having an operating mechanism which comprises a linear solenoid actuator having a central longitudinal axis, the linear solenoid actuator comprising an electromagnet coil and stator structure associated with the coil for conducting magnetic flux created as a result of electric current flow in the coil, the stator structure comprising an air gap disposed coaxial with the axis, a mass that is positioned by the linear solenoid actuator along the axis, the mass including an armature disposed coaxial with the axis proximate the air gap for positioning along the axis as a function of magnetic force resulting from electric current flow in the coil and a valve element that is positioned axially by and with the armature in relation to a valve seat for establishing the extent to which the canister purge valve allows flow through the purge flow path, the mass bearing a relationship to electric current flow in the coil such that over a range of less than fully open positions wherein the valve element is unseated from the valve seat, the mass is positionable to plural discrete positions within that range each discrete position corresponding to a respective D.C. current component value of the electric current flow in the coil.

2. An electrically-operated canister purge valve as set forth in claim 1 in which the mass, while positioned at any particular one of the plural discrete positions within the range, can follow a fluctuating component of the electric current flow in the coil without the valve element contacting the valve seat.

3. An electrically-operated canister purge valve as set forth in claim 1 in which the electromagnet coil comprises a through-hole that is coaxial with the axis, and the air gap is disposed within the through-hole of the electromagnet coil.

4. An electrically-operated canister purge valve as set forth in claim 1 in which the operating mechanism includes a bias spring for exerting a spring force to urge the mass along the axis in a direction of seating the valve element on the valve seat.

5. An electrically-operated canister purge valve as set forth in claim 4 in which the bias spring has a substantially linear force vs. compression characteristic.

6. An electrically-operated canister purge valve as set forth in claim 1 further including an electric circuit for applying the purge control signal to the valve as a pulse-width-modulated signal that creates electric current in the coil which comprises a D.C. component for causing the mass to be positioned to a respective one of the plural discrete positions, and a fluctuating component that causes the mass to execute a fluctuating motion along the axis about the respective one of the plural discrete positions without the valve element contacting the seat.

7. An electrically-operated canister purge valve for controlling purging of fuel vapors from a vapor collection canister to an internal combustion engine in accordance with a purge control signal that sets the extent to which the canister purge valve allows purge flow, the canister purge valve comprising a linear solenoid actuator having a central longitudinal axis, the linear solenoid actuator comprising an electromagnet coil and stator structure associated with the coil for conducting magnetic flux created as a result of current flow in the coil, the stator structure comprising an air gap disposed coaxial with the axis. an armature that is disposed coaxial with the axis, proximate the air gap for positioning along the axis as a function of magnetic force resulting from current flow in the coil a valve element that is positioned axially by and with the armature in relation to a valve seat for establishing the extent to which the canister purge valve allows flow through the purge flow path, the armature having an association with the stator structure such that an axial component of magnetic force acting on the armature in a direction that increasingly opens the valve, is substantially linearly related to the average current flow in the coil over an operating range of average current flows, a bias spring that exerts a spring force that urges the armature and valve element toward the valve seat, and an electric circuit for applying the purge control signal to the valve as a pulse-width-modulated signal that creates in the coil an electric current waveform which comprises a D.C. component that is selectable over a range of D.C. component values for causing the armature to be positioned to a corresponding position along the axis over a range of positions linearly related to the range of D.C. component values, and a fluctuating component that is related to frequency of the pulse-width-modulated signal to cause the armature to execute a fluctuating motion along the axis about the position to which the armature is positioned by the D.C. component.

8. An electrically-operated canister purge valve comprising a purge flow path adapted to be disposed between an intake manifold of an internal combustion engine and a fuel vapor collection canister of a fuel vapor collection system for such an engine, wherein such a canister collects vapor generated by volatile fuel in a fuel tank, said canister purge valve controlling the purging of such a canister to such an intake manifold in accordance with a purge control signal that sets the extent to which said canister purge valve allows purge flow through said purge flow path, said canister purge valve comprising a linear solenoid actuator having a central longitudinal axis and comprising an electromagnet coil and stator structure associated with said coil for conducting magnetic flux created as a result of current flow in said coil, said stator structure comprising an air gap disposed coaxial with said axis, an armature that is disposed coaxial with said axis proximate said air gap for positioning along said axis as a function of magnetic force resulting from current flow in said coil, a valve element that is positioned axially by and with said armature in relation to a valve seat for establishing the extent to which the canister purge valve allows flow through said purge flow path, said armature having an association with said stator structure such that an axial component of magnetic force acting on said armature in a direction that increasingly opens said valve, is substantially linearly related to the average current flow in said coil over an operating range of average current flows, a bias spring that exerts a spring force that urges said armature and valve element toward said valve seat, and an electric circuit for applying the purge control signal to the valve as a pulse-width-modulated signal that creates in the coil an electric current waveform which comprises a D.C. component that is selectable over a range of D.C. component values for causing the armature to be positioned to a corresponding position along said axis over a range of positions linearly related to the range of D.C. component values, and a fluctuating component that is related to frequency of the pulse-width-modulated signal to cause the armature to execute a fluctuating motion along the axis about the position to which the armature is positioned by the D.C. component.

9. An electrically-operated canister purge valve as set forth in claim 8 in which the electromagnet coil comprises a through-hole that is coaxial with the axis, and the air gap is disposed within the through-hole of the electromagnet coil.

10. An electrically-operated canister purge valve as set forth in claim 8 in which the bias spring also has a substantially linear force vs. compression characteristic.

* * * * *